US006231398B1

(12) United States Patent
Furutani et al.

(10) Patent No.: US 6,231,398 B1
(45) Date of Patent: May 15, 2001

(54) CONNECTOR WITH UPPER AND LOWER INNER HOUSING MEMBERS

(75) Inventors: Mitsugu Furutani; Masahiko Aoyama, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/280,670

(22) Filed: Mar. 29, 1999

(30) Foreign Application Priority Data

Apr. 15, 1998 (JP) ..... 10-105120

(51) Int. Cl.[7] ..... H01R 13/502; H01R 13/514

(52) U.S. Cl. ..... 439/701

(58) Field of Search ..... 439/701, 660, 439/717, 715, 712, 709

(56) References Cited

U.S. PATENT DOCUMENTS 5,122,077 6/1992 Maejima et al. ..... 439/398
5,320,555 * 6/1994 Okabe ..... 439/354
5,573,430 * 11/1996 Hatagishi ..... 439/701
5,957,732 * 9/1999 Ito et al. ..... 439/752
5,967,842 * 10/1999 Okabe ..... 439/596

FOREIGN PATENT DOCUMENTS

3526664 A1 2/1986 (DE) .

* cited by examiner

*Primary Examiner*—Khiem Nguyen
*Assistant Examiner*—Michael C. Zarroli
(74) *Attorney, Agent, or Firm*—Banner & Witcoff, Ltd.

(57) ABSTRACT

A connector including an inner housing member for housing terminal fittings and an outer member for receiving the inner housing member. The inner housing member comprises upper and lower inner members. After terminal fittings have been attached to the upper and lower inner members, these inner members are joined to one another to form the inner housing member. An angular-tubular shaped housing chamber is provided at the posterior of an outer member for housing the inner housing member. The inner housing member is pushed into the housing chamber of the outer member to complete the assembly of the connector. The connector also includes a latch that prevents the inner and outer members from being easily released, and in which rattling or vibration of the upper and lower inner members is prevented.

12 Claims, 15 Drawing Sheets

CONNECTOR WITH UPPER AND LOWER INNER HOUSING MEMBERS

TECHNICAL FIELD

The present invention relates to an electrical connector.

BACKGROUND TO THE INVENTION

FIG. 22 of this specification shows a connector as described in JP-2-148583. This connector comprises an outer member 101 which allows the insertion of pressure contact terminal fittings (not shown) at three levels in a height-wise direction. This outer member 101 has spaces formed in a unified manner which allow the insertion of the pressure contact terminal fittings in the upper step, while the middle and lower steps accommodate two separate inner members 102, each formed as separate bodies, and both being capable of being inserted into the outer member 101. An angular tubular shaped attachment region 104 is provided on the anterior portion of the outer member 101, the portion thereof which houses the terminal fittings of the upper step forming terminal housing chambers 103. These terminal housing chambers 103 are partitioned, from left to right, into four compartments, and open out in an upwards direction. The upward opening of these terminal housing chambers allows the protrusion of pressure contact blade portions of the pressure contact terminal fittings housed therein. The posterior half of each inner member 102 has identically configured terminal housing chambers 103 formed therein, these terminal housing chambers 103 fitting together when they are attached to the outer member 101. Fitting holes 106 pass through side walls of the attachment member 104, and correspond to the inner members 102, and two sets of fitting holes 106 pass through the side walls of the attachment member 104 at anterior and posterior locations respectively.

Fitting protrusions 107 protrude from the anterior of the side faces of the inner members 102. When these fitting protrusions 107 fit with the posteriorly located fitting holes 106, the terminal housing chambers 103 protruding stepwise as shown. When the fitting protrusions 107 fit with the anteriorly located fitting holes 106, the terminal housing chambers 103 are aligned. Further, in addition to the members 101 and 102, the connector is provided with a locking member 105 which fits with locking protrusions 108. This locking member 105 covers the upper step terminal housing chamber 103 and supports the connection of the members 101 and 102. Locking holes 109 are formed on this locking member 105, these fitting with the locking protrusions 108 of the two inner members 102.

In order to assemble the connector, configured as described above, the terminal fittings are first housed within each terminal housing chamber 103. Next, the inner members 102 are inserted into the attachment member 104, this causing the fitting holes 106 to fit with the fitting protrusions 107. This fixes the position of the anterior ends of the inner members 103 in an up and down and anterior/posterior direction.

Next, the locking member 105 is attached from above the outer member 101, this causing the locking holes 109 and the locking protrusions 108 to fit together. This strengthens the connecting force between the two members 101 and 102, and fixes the position of the posterior ends of the inner members 102 in an up-down and anterior-posterior direction.

However, there is no means provided to maintain the middle and lower steps of the inner members 102 of this connector in a mutually and directly joined state, and the joining force of the posterior half of the inner members 102 depends mostly on the locking member 105. However, the inner members 102 of the connector are in a state whereby they protrude towards the exterior and, as a result, external force is easily exerted upon them. In such a case, the inner members 102 may shift position; problems may occur, such as the pitch of the cavity altering, and the locking member 105 may be unintentionally separated.

Nevertheless, in a connector that solves the above problem, it may be necessary to separate the inner and outer members for maintenance, etc. This separation operation should be easy to perform so that the operability of the connector improves.

The present invention has been developed after taking the above problems into consideration, and aims to present a connector in which the lock joining the inner and outer members will not be released inadvertently, in which the looseness of the join between the two inner members and between the inner and outer members can be regulated, and in which the releasing operation of the assembled connector can be performed smoothly.

SUMMARY OF THE INVENTION

According to the invention, there is provided an electrical connector comprising inner housings adapted to be layered together, said inner housings each being adapted to receive a pressure contact terminal such that a connection part of the respective terminal is exposed in situ for the pressure connection of a respective electrical wire, and an outer housing adapted to receive the inner housings therein, characterised in that the outer housing is adapted to retain the inner housings in a layered state, and latching means are provided to retain the inner housings in said outer housing.

Such an arrangement both retains the inner housings, and maintains them in engagement.

Preferably the latching means comprise a protrusion, and a resilient tongue. The protrusion may have rounded shoulders to ease engagement thereof. The corresponding wall portion of the housing may be relatively thin to ease the passage of the abutment; local thickening may be provided on either side of the thinned portion.

A channel may be provided in the protrusion and in a step of the outer housing to both guide a release tool of the tongue, and to act as a fulcrum therefor.

The inner housings may include a nose engageable in an end wall recess of the outer housing to limit relative insertion of the inner housing. Preferably the nose protrudes through said end wall by an amount exactly equivalent to the maximum clearance between said protrusion and tongue; such a clearance is necessary to give assured latching engagement. Connection of the connector with a mating connector causes the nose of the inner housings to be pushed back until the clearance is eliminated; in this condition the nose is flush with the outer side of the end wall, and rattling or vibration of the inner housings is eliminated.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

An embodiment of the present invention will be explained with the aid of FIGS. 1 to 21.

Figure 1:
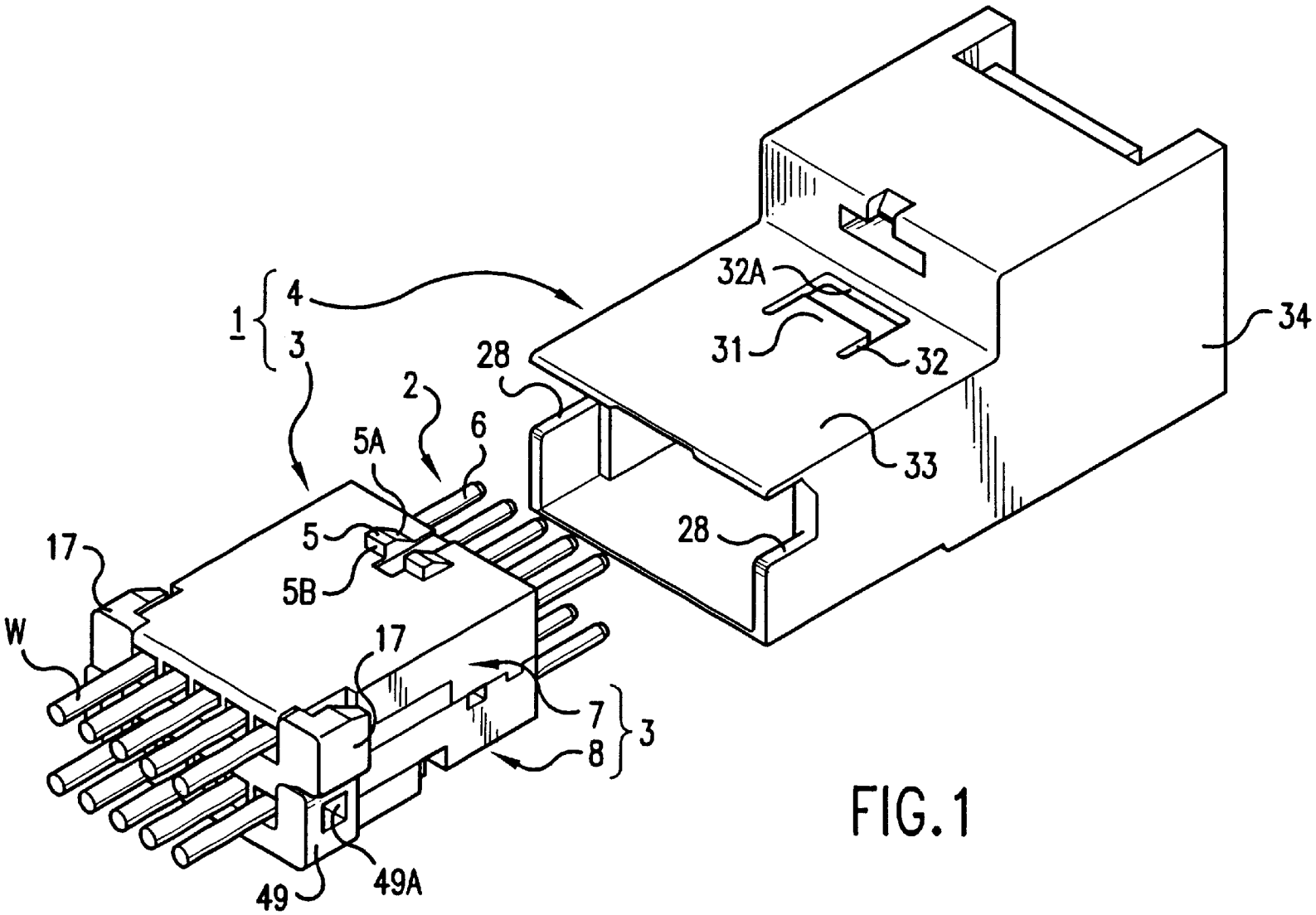
FIG. 1 is a diagonal view of a connector according to the invention showing an inner member in a joined state prior to being housed within an outer member.

As FIG. 1 shows, a connector 1 comprises an inner member 3 for housing terminal fittings 2, and an outer member 4 which houses the inner member 3. As will be explained later, the inner member 3 comprises connected upper and lower inner members 7 and 8. In order to simplify the explanation, inner member 3 will refer to both the upper and lower inner members 7 and 8 when these are in a joined-together state.

In the following explanation, as shown in FIG. 1, the direction in which stopping protrusions 5 of the inner member 3 protrude will be considered to be the upper side, while the direction in which tabs 6 of the terminal fittings 2 protrude from the inner member 3 will be considered to be the anterior side.

Terminal Fittings

Figure 3:
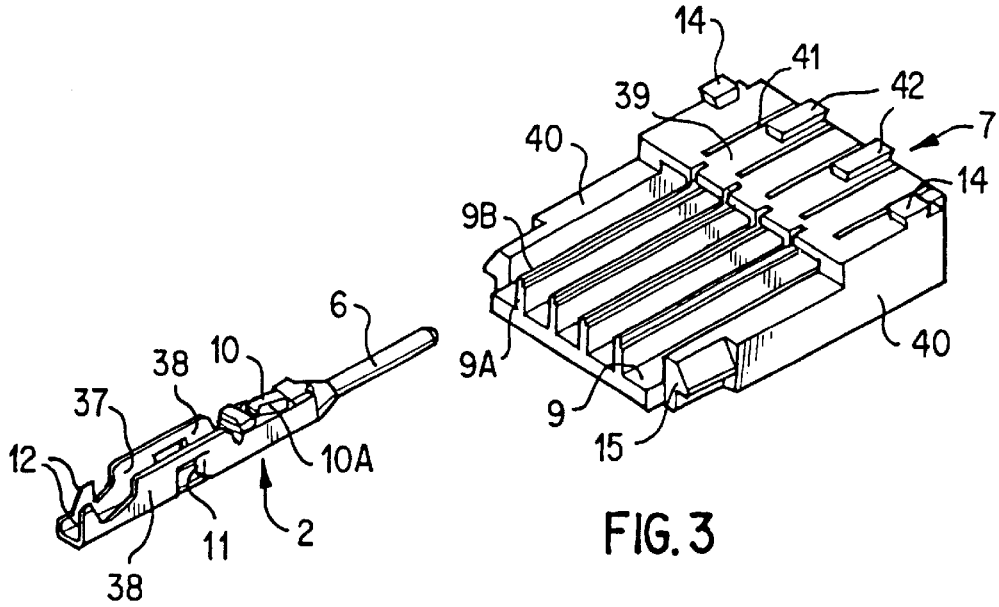
FIG. 3 is a diagonal view showing the upper inner member from the rear face.
Figure 4:
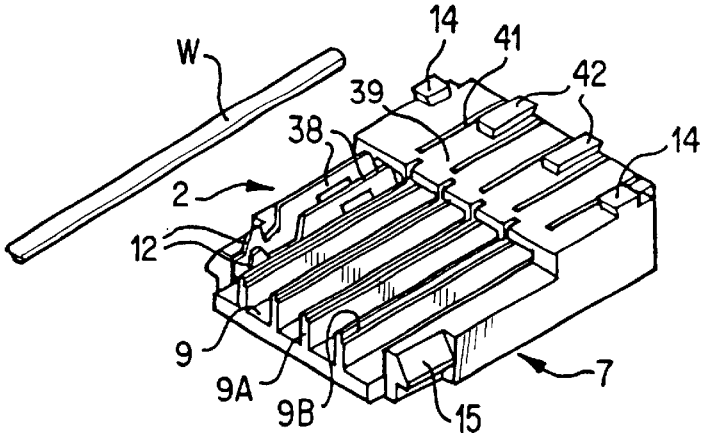
FIG. 4 is a diagonal view showing a terminal fitting about to be attached to the upper inner member.
Figure 5:
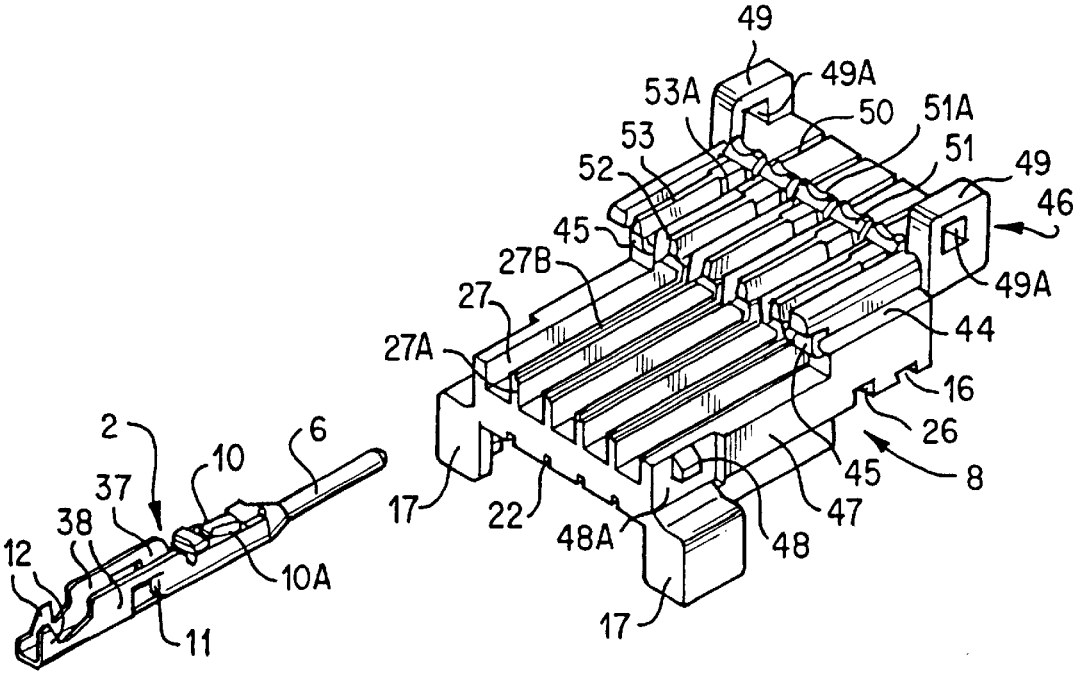
FIG. 5 is a diagonal view showing the lower inner member from the rear face.
Figure 6:
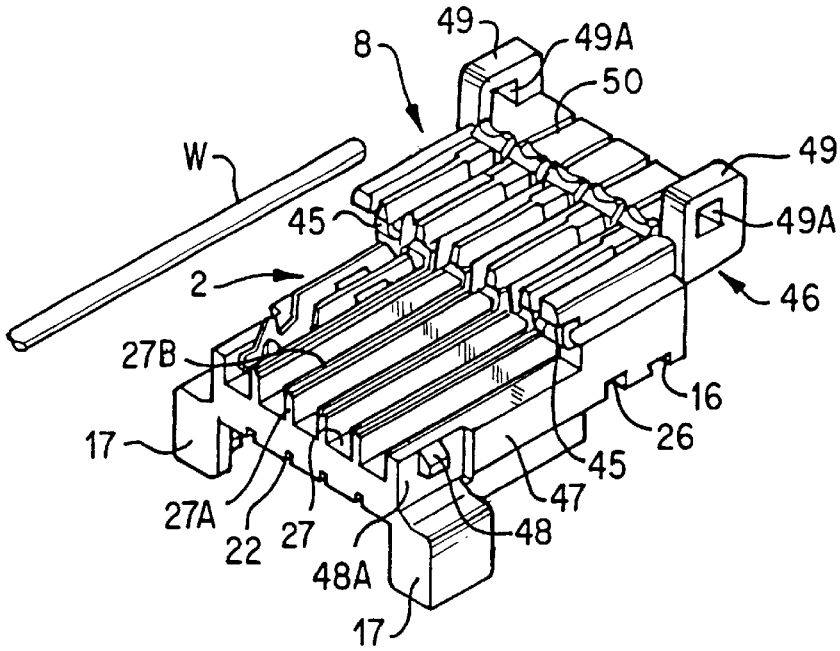
FIG. 6 is a diagonal view showing a terminal fitting about to be attached to the lower inner member.

As shown in FIG. 3 etc., the terminal fittings 2 are provided on the male side and comprise electrically conductive sheet metal which has been bent, these joining with corresponding female terminal fittings (not shown). These terminal fittings 2 will be termed pressure contact terminal fittings since they are connected to insulated electric wires W by these being pushed on from above. The tabs 6 protrude from the anterior of the terminal fittings 2, these tabs 6 connecting with the corresponding female terminal fittings. A bendable lance 10 is formed by cutting-away at the posterior of each tab 6. The right edge portion of each lance 10 is folded upwards to form a stopping edge 10A. Furthermore, the left and right side edges of the terminal fitting 2 are folded over to form a pair of side walls 38. An electric wire insertion groove 37 is formed in the space between the pair of side walls 38, the electric wire W being inserted into this groove 37 on the side from which the lance 10 was cut away.

A pair of left and right barrels 12 protrude from the posterior of the side walls 38, these crimping the wire W. This pair of barrels 12 protrudes from asymmetrical positions relative to one another long the anterior-posterior direction of the terminal fitting 2. A pair of pressure contact blades 11 are cut anteriorly and posteriorly into the sides of the insertion groove 37, these pressure contact blades 11 being located in the centre of the two side walls 38 and symmetrical. The groove between the tips of the pressure contact blade 11 is slightly smaller in width than the insulated portion of the wire W. Then the wire W is pushed in from the opening side of the pressure contact blade 11, the pressure contact blade 11 cuts into insulation. In this manner, the wire core makes contact with the pressure contact blade 11, and the wire W and the terminal fitting 2 make electrical contact.

Inner Member

Figure 2:
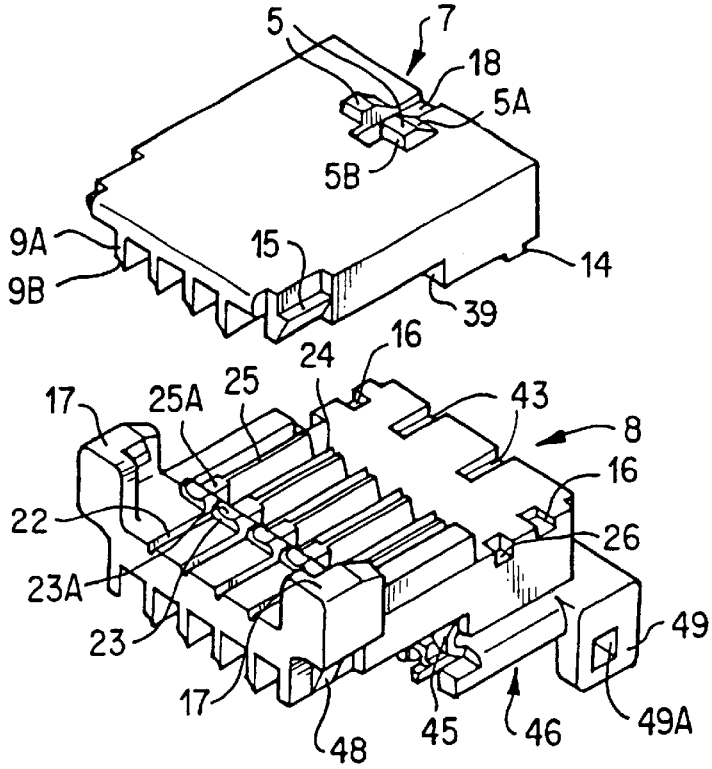
FIG. 2 is a diagonal view showing an upper and a lower inner member in a separated state.

As shown in FIG. 2, the inner member 3 comprises two connected upper and lower inner members 7 and 8. The upper and lower inner members 7 and 8 are both made from moulded plastic, and the interiors thereof house the terminal fittings 2.

Upper Inner Member

Figure 8:
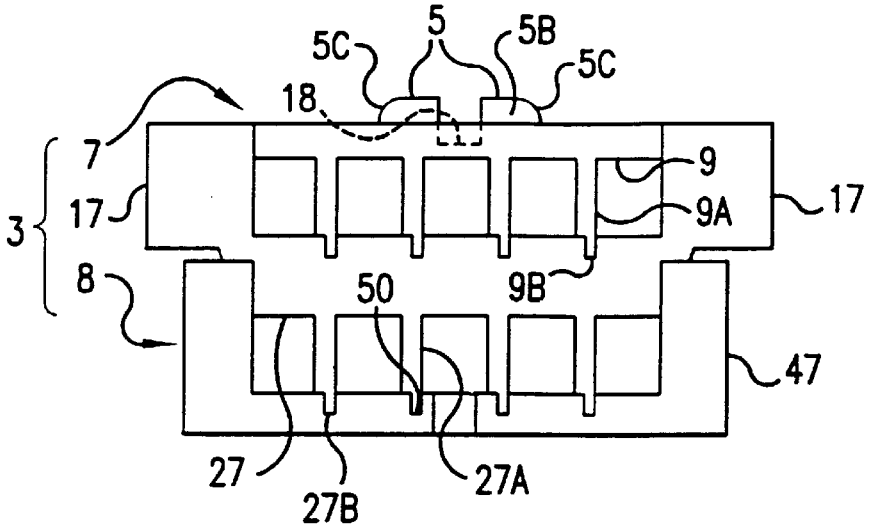
FIG. 8 is a rear face view of the inner member in a joined state.
Figure 9:
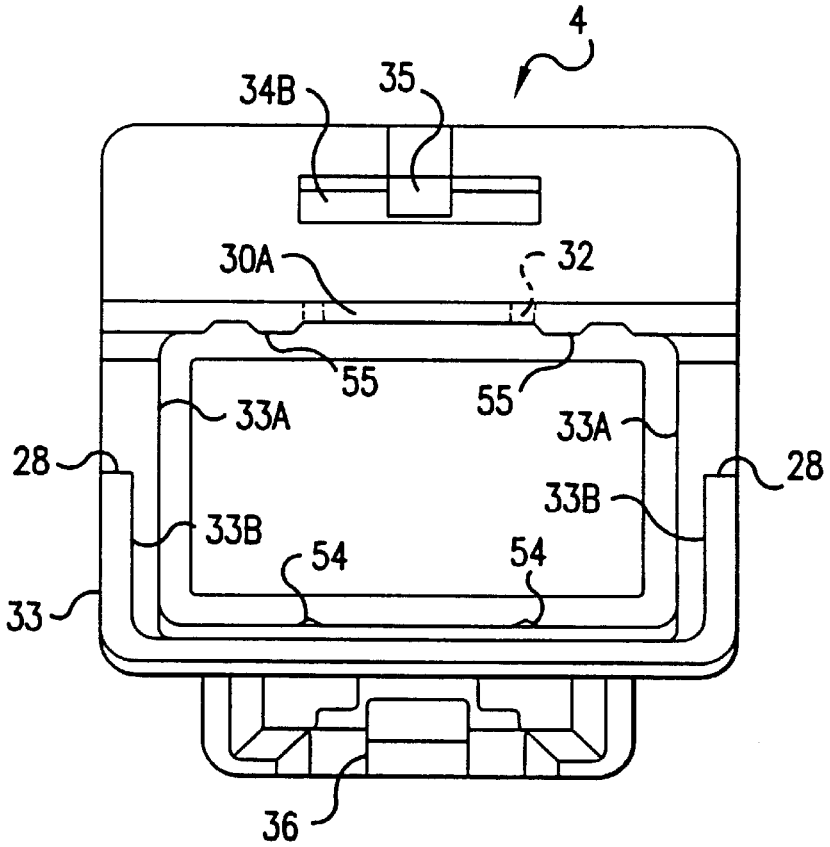
FIG. 9 is a rear face view of the outer member.
Figure 10:
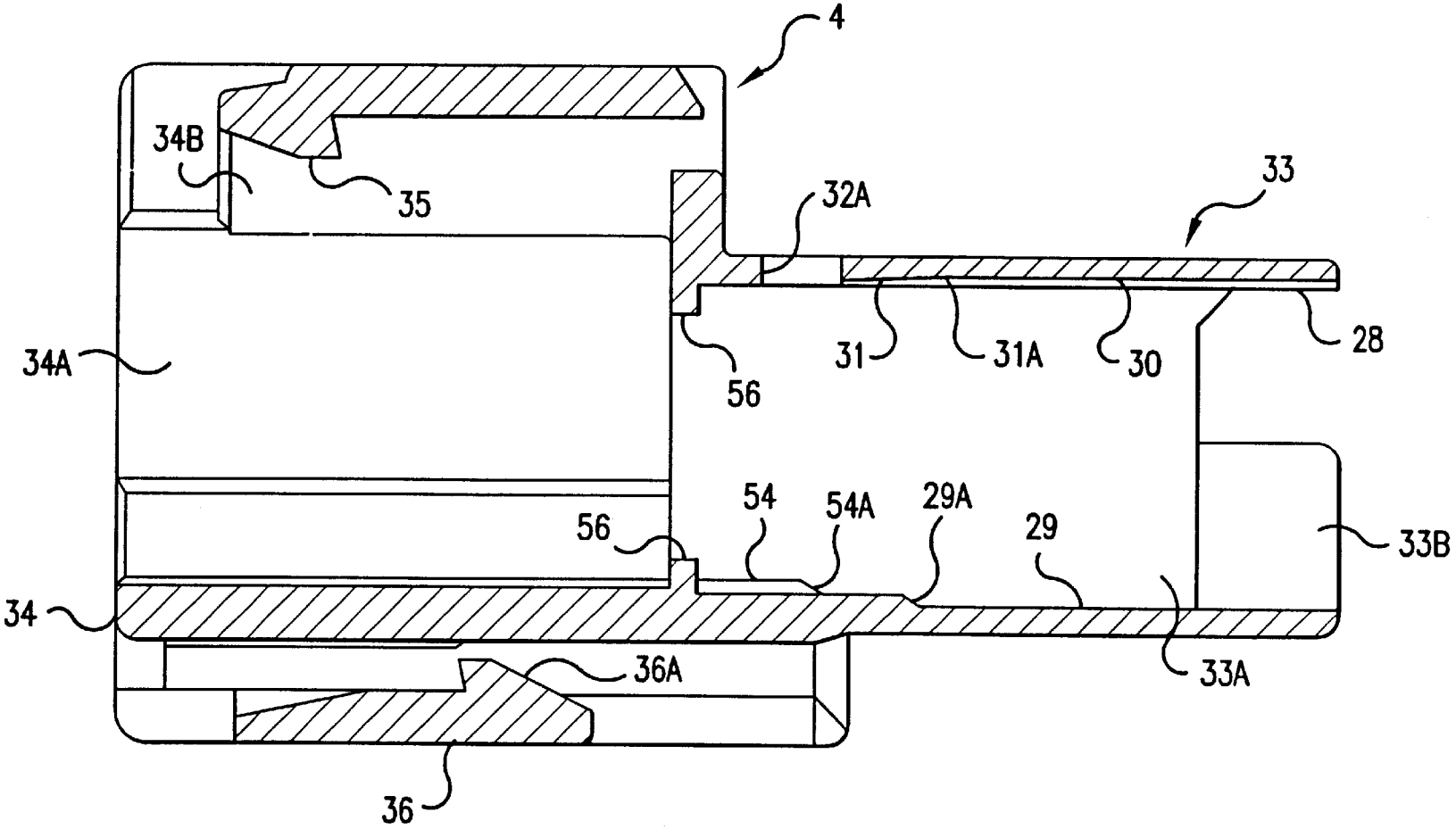
FIG. 10 is a side cross-sectional view of the outer member.
Figure 11:
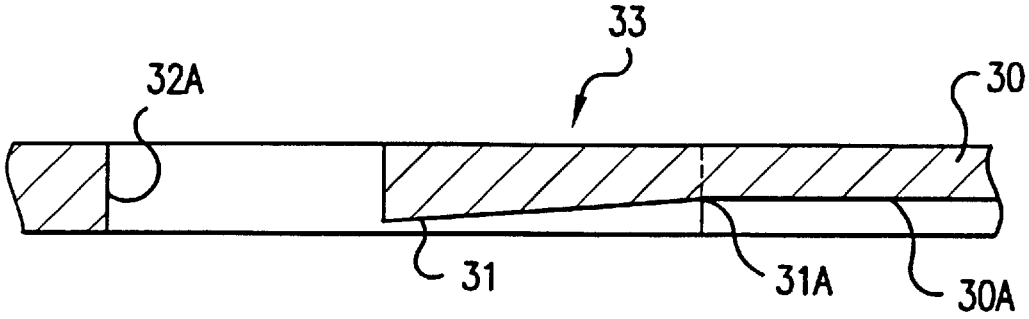
FIG. 11 is a partially enlarged side cross-sectional view of the outer member.
Figure 12:
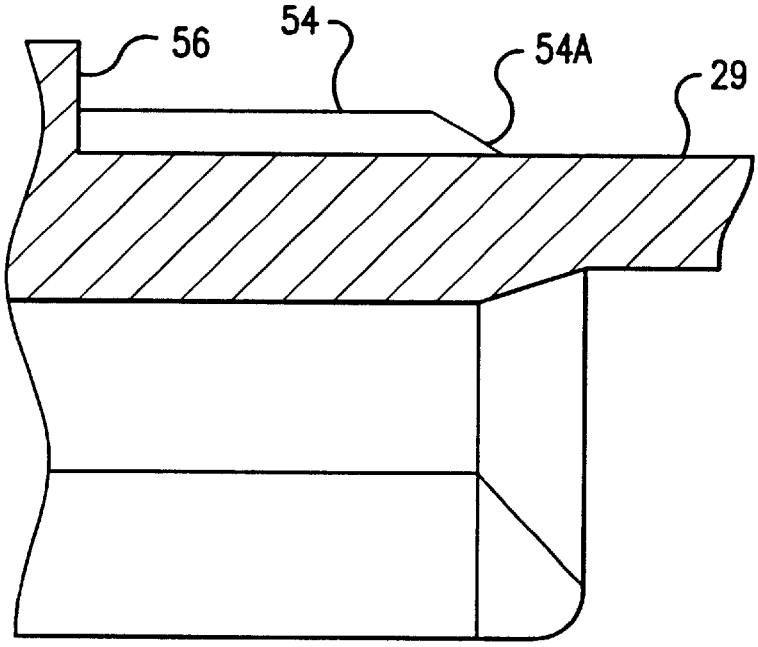
FIG. 12 is a partially enlarged side cross-sectional view of the outer member.

As shown in FIG. 2, a pair of left and right stopping protrusions 5 protrude from the anterior central portion of the upper face of the inner member 7. A fitting releasing groove 18, into which a release tool or jig 21 is inserted, runs down the centre of these two stopping protrusions 5. This groove 18 is provided from the anterior edge of the inner member 7 and passes through the stopping protrusions 5 to a location slightly to the posterior thereof. The jig 21 is inserted into the fitting releasing groove 18 in order to separate the inner member 3 and the outer member 4 after the connector 1 has been assembled. Guiding faces 5A are formed on the anterior faces of the stopping protrusions 5, and stopping faces 5B are formed on the posterior faces of the stopping protrusions 5, these stopping faces 5B being perpendicular with respect to the upper face of the inner member 7. Further, as FIG. 8 shows, the outer shoulders 5C of the protrusions 5 are rounded.

Furthermore, terminal housing chambers 9 for housing the terminal fittings 2 are formed on the lower face of the inner member 7 (see FIG. 3). Side walls 40 are formed on the left and right of the inner member 7, and dividing walls 9A are provided at identical distances from one another between these side walls 40. The terminal housing chambers 9 are formed in the divisions between these dividing walls 9A. The anterior end of each terminal housing chamber 9 is provided with a cover 39 which covers the lower face thereof and which, from the centre to the posterior, leaves the pushed-in portion of the wire W open. The cover 39 connects with the two side walls 40. A lance stopping groove 41 is formed in an anterior-posterior direction on the cover 39 at a location corresponding to the right side edge portion of each terminal housing chamber 9, the stopping edge 10A of the terminal fitting 2 fitting into this lance stopping groove 41. Furthermore, as shown in FIG. 3, only the left halves of protruding edges of the dividing walls 9A protrude, these forming step-shaped fitting edges 9B. Dovetailed tenons 14 and 42 protrude from the cover 39, these serving as stopping members which hold the inner members 7 and 8 engaged. The tenons 42 are a left and right pair located towards the central portion of the cover 39. Seen from the left or right sides of the inner member 7 these tenons are fan-shaped, while seen cross-sectionally from the front they have a trapezoid shape. The tenons 14 are located at the left and right sides of the cover 39. Seen from the anterior or posterior sides of the inner member 7 these tenons are fan-shaped while, seen cross-sectionally from the side they have a trapezoid shape. The engagement of the dovetailed tenons 14 and 42 is thereby strengthened in either the anterior-posterior direction or the left-right direction, and the inner members 7 and 8 are retained in a balanced manner. The tenons 14 and 42 are engaged respectively in dovetailed grooves 16 and 43 located on the lower inner member 8. These act as receiving members. Furthermore, stopping claws 15 are formed on the posterior end portion of the left and right side walls 40, and are formed by a cut-away portion of the side walls 40, the anterior end of each claw 15 being connected with the side wall 40. The claws 15 fit with claw receiving members 17 located on the lower side of the inner member 8.

Lower Inner Member

As shown in FIG. 2, the upper face of the lower inner member 8 is configured so as to fit with each terminal housing chamber 9 of the upper inner member 7, and to maintain the terminal fittings 2 in a stable manner. That is, the posterior end of the inner member 8 is higher than the central or anterior portions thereof, and dividing-wall housing grooves 22 are formed therein in order to house the fitting edges 9B of the dividing walls 9A. Wire supporting members 23 protrude at an anterior location from the dividing-wall housing grooves 22, these supporting members 23 being provided with pushing faces 23A which are curved and which correspond to the external diameter of the wires W. The supporting members 23 push down on the wire W behind the posterior edge of the two side walls 38 of the terminal fittings 2. The anterior ends of the supporting members 23 form lower, dividing walls 24. These correspond to the location of the dividing walls 9A. Only half of the protruding edges of the dividing walls 24 protrude, these being on the left in FIG. 2, and forming step-shaped fitting edges 24A. In this manner, the step-shaped fitting edges 9B and 24A of the upper and lower dividing walls 9A and 24 are formed in a complementary manner, and the step-shaped fitting edges 9B and 24A fit together with virtually no space between the two when the two dividing walls 9A and 24 are fitted together. A wire pressing member 25 protrudes in an anterior-posterior direction from the centre of each dividing wall 24. These pressing members 25 protrude higher than the dividing walls 24, and the posterior portion thereof is wider, forming a wide member 25A. Each pressing member 25 is positioned so as to be located in the interior of the insertion groove 37, and presses down on the wire W. The wide members 25A are located behind the pressure contact blade 11 located towards the posterior of the terminal fittings 2.

The dovetailed grooves 16 and 43 are located at the anterior side of the inner member 8, these fitting with the dovetailed tenons 14 and 42 which protrude from the inner member 7. Jig grooves 26 are formed at a location to the posterior of the dovetailed grooves 16 located on the side edges. These jig grooves 26 allow the jig 21 to be inserted to release the fitting of the inner members 7 and 8. Further, a pair of claw receiving members 17 protrude from both posterior side edges of the upper face of the inner member 8. These claw receiving members 17, which protrude towards the exterior from the posterior ends of the inner member 8, can be bent slightly outwards, while the claws 15 fit with their inner sides. The width of the claw receiving members 17 is either the same or slightly narrower than that of the outer member 4 (to be described later).

The lower face of the inner member 8 is provided with terminal housing chambers 27 for housing the terminal fittings 2. These terminal housing chambers 27 have approximately the same configuration as the terminal housing chambers 9 of the upper inner member 7. That is, each terminal housing chamber 27 is separated by a dividing wall 27A, the protruding edges of these dividing walls 27A forming step-shaped fitting edges 27B. Further, a cover 44 is provided on the anterior side of the terminal housing chambers 27, this cover 44 joining with left and right side walls 47 and resulting in the interior of the terminal housing chambers 27 having an angular tubular shape. A lance stopping groove is formed on the cover 44 at a location corresponding to the right side edge portion of each terminal housing chamber 27, these lance stopping grooves being formed in an anterior-posterior direction relative to the inner member 8. (These lance stopping grooves are not shown in FIG. 5 or 6; however, they are identical with the lance stopping grooves 41 of the inner member 7). Furthermore, claws 48 are formed on the posterior end portion of the left and right side walls 47, these acting as stopping members. These claws 48 are formed on thin flat faces 48A located towards the posterior of the side walls 47, and protrude from the central portion of the flat faces 48A to the outer faces of the side walls 47. The claws 48 fit with claw receiving members 49 that are provided on the cover 44.

A rotatable cover 46 is joined to the posterior end of the cover 44 via a pair of left and right hinges 45. The rotatable cover 46 can be rotated about the hinges 45 and, after the terminal fittings 2 have been housed in the terminal housing chambers 27, the rotatable cover 46 covers the terminal housing chambers 27. Further, the rear face of the rotatable cover 46 (the face covering the terminal housing chambers 27) has the same configuration as the upper face of the inner member 8. That is, the posterior end of the rotatable cover 46 is higher than the central or anterior portions of the rotatable cover 46, and dividing-wall housing grooves 50 are formed in this posterior end in order to house the fitting edges 27B of the tips of the dividing walls 27A. Wire supporting members 51 protrude at a location anterior to the dividing-wall housing grooves 50, these supporting members 51 being provided with pushing faces 51A which correspond to the external diameter of the wires W. The supporting members 51 push down on the wire W at a location behind the posterior edge of the two side walls 38 of the terminal fittings 2. Further, the anterior end of the supporting members 51 form lower, dividing walls 52 corresponding to the location of the dividing walls 27A.

Fitting edges 52A are formed in a step-shape on the tips of the dividing walls 52, these being formed in a complementary manner so as to fit with the fitting edges 27B. A wire pressing member 53 protrudes from the centre of each dividing wall 52, is higher than the dividing walls 52, and the posterior portions thereof form a wide members 53A. Each pressing member 53 is positioned so as to be located inside the insertion groove 37 of the terminal fitting 2, and pressed down on the wire W. The wide members 53A are located behind the pressure contact blade 11. A pair of claw receiving members 49 protrude from both sides of the posterior portion of the rotatable cover 46. These claw receiving members 49 are capable of bending slightly outwards relative to the rotatable cover 46, while receiving holes 49A, formed at the centre of the claw receiving members 49, fit with the claws 48.

The Joining of the Upper and Lower Inner Members

Firstly, before joining the inner members 7 and 8, the terminal fittings 2 are attached to the inner members 7 and 8.

The upper inner member 7 is explained first. As shown in FIG. 3, the terminal housing chambers 9 of the inner member 7 are placed so as to face upwards, and the terminal fittings 2 are attached thereto. The terminal fittings 2 are pushed in and the lances 10 bend downwards, making contact with the lower face of the cover 39. The lances 10 change shape and return to their original position when the terminal fittings 2 are pushed in to the correct position, and the stopping edges 10A fit with the posterior edges of the lance stopping grooves 41. At this juncture, the insertion grooves 37 are in a state whereby they are open at the top (see FIG. 4). The respective wire W is inserted from the top of the terminal fittings 2 towards the pressure contact blades 11 which cut the insulated portion of the wires W and make electrical contact with the interior core wire. Furthermore, at this juncture, the barrel 12 is bent so as to surround the wire W, and the joining operation of the wire W and the terminal fittings 2 is thus completed.

The terminal housing chambers 27 of the lower inner member 8 are placed so as to face upwards, and the terminal fittings 2 are attached thereto. The terminal fittings 2 are pushed in to a prescribed position, this causing the stopping edges 10A of the lances 10 to be stopped by the posterior edges of the lance stopping grooves 41, thus stopping the terminal fittings 2 in the terminal housing chambers 27 (see FIG. 6). After this, the pressing operation of the wires W onto the pressure contact blades 11 of the terminal fittings 2 is the same as that described for the inner member 7, and accordingly an explanation thereof is omitted.

Figure 7:
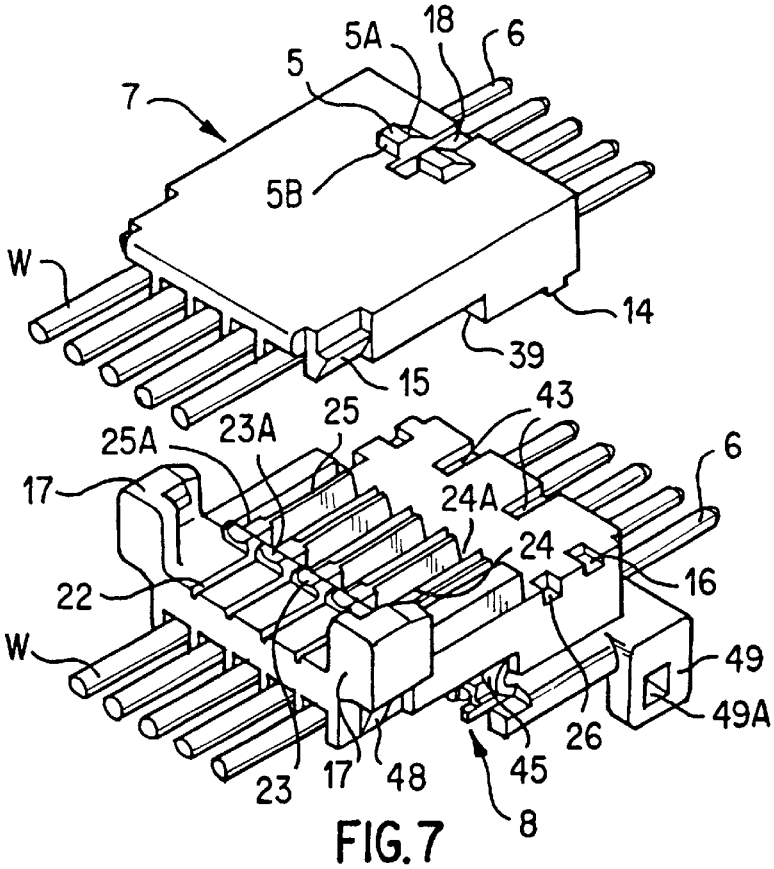
FIG. 7 is a diagonal view showing the inner member with terminal fittings attached and prior to being joined together.

In this manner, the attachment of the terminal fittings 2 to the upper and lower inner members 7 and 8 is completed, and the upper and lower inner members 7 and 8 can be joined together. FIG. 7 shows these upper and lower inner members 7 and 8 in a state prior to being joined together. First, an explanation will be given for the lower inner member 8. The rotatable cover 46 is rotated and is attached so as to cover the terminal housing chambers 27. The attachment continues with the stopping claws 48 bending the claw receiving members 49 upwards until the receiving holes 49A fit with the claws 48. The claw receiving members 49 return to their original position, and the attachment of the inner member 8 is complete. After this, the inner members 7 and 8 are joined together. The terminal housing chambers 9 of the upper inner member 7 are placed against the upper face of the lower inner member 8, and both inner members 7 and 8 are pushed together. The dovetailed tenons 14 and 42 and the corresponding dovetailed grooves 16 and 43 located at the anterior of the inner members 7 and 8 fit together. Furthermore, at the posterior of the inner members 7 and 8, the claw receiving members 17 are bent slightly outwards by the stopping claws 15 until they fit together. In this fitted state the inner members 7 and 8 form the inner member 3.

Figure 13:
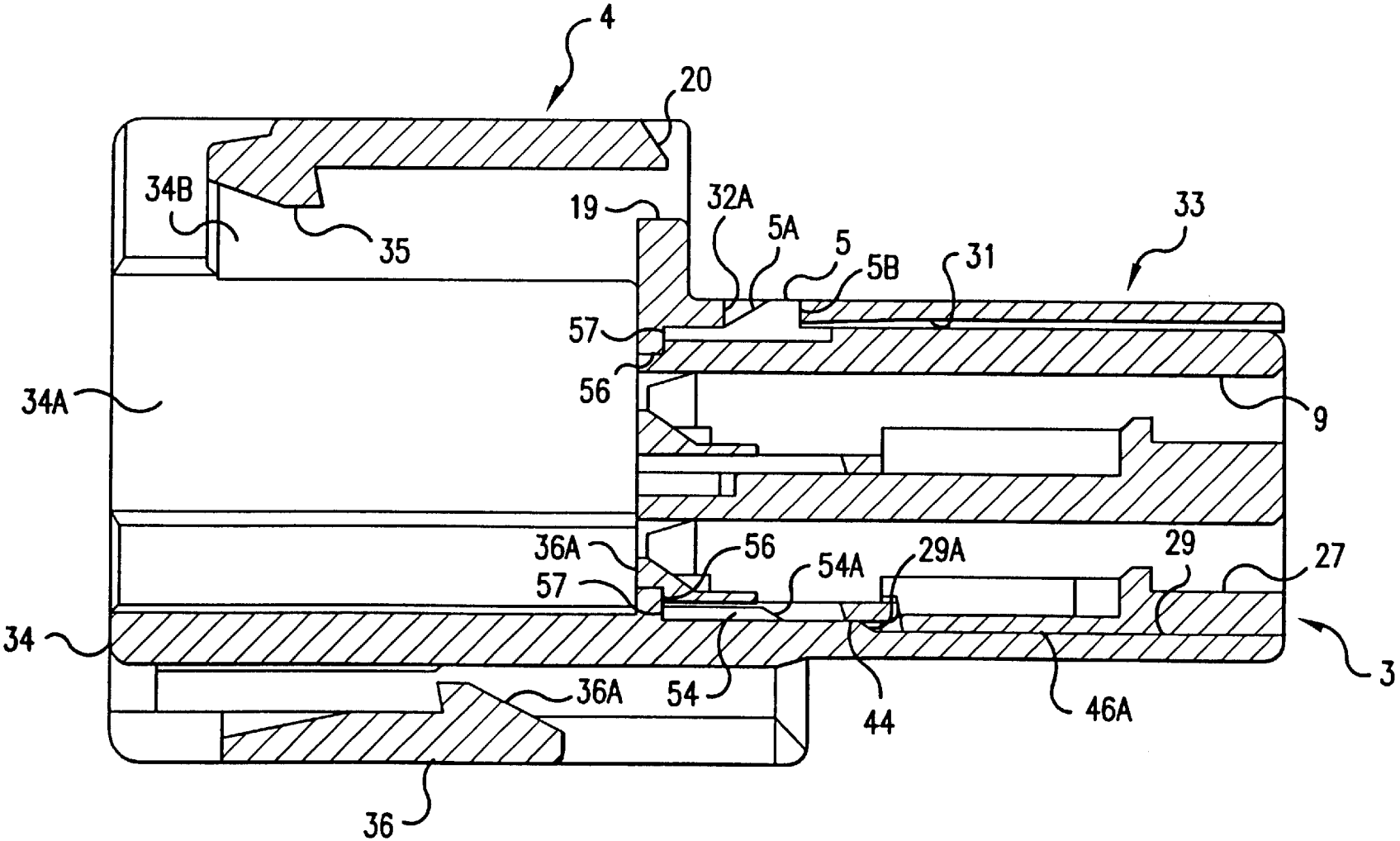
FIG. 13 is a side cross-sectional view of the inner member and the outer member in a joined state (in a state without terminal fittings).
Figure 14:
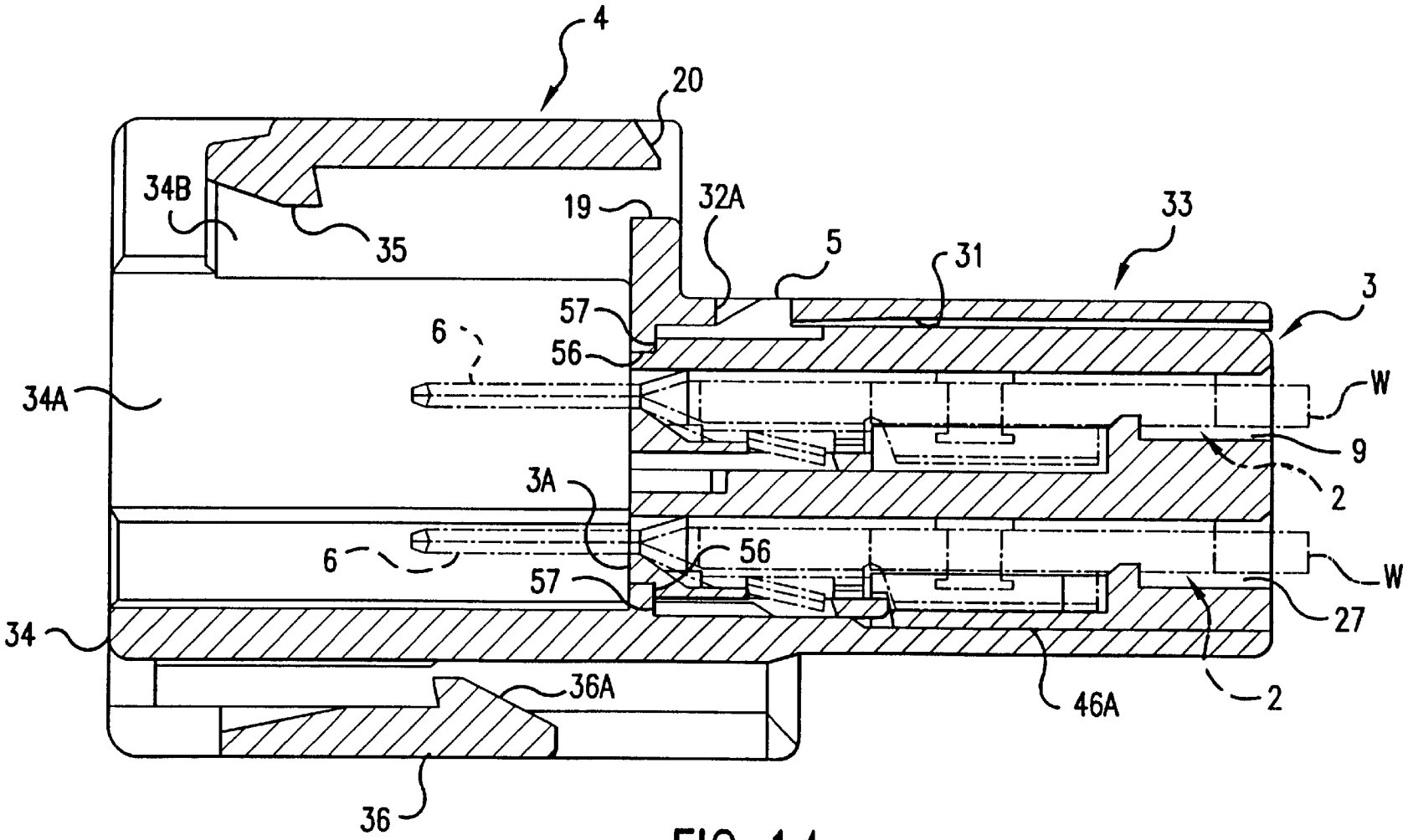
FIG. 14 is a side cross-sectional view of the inner member and the outer member in a joined state.
Figure 15:
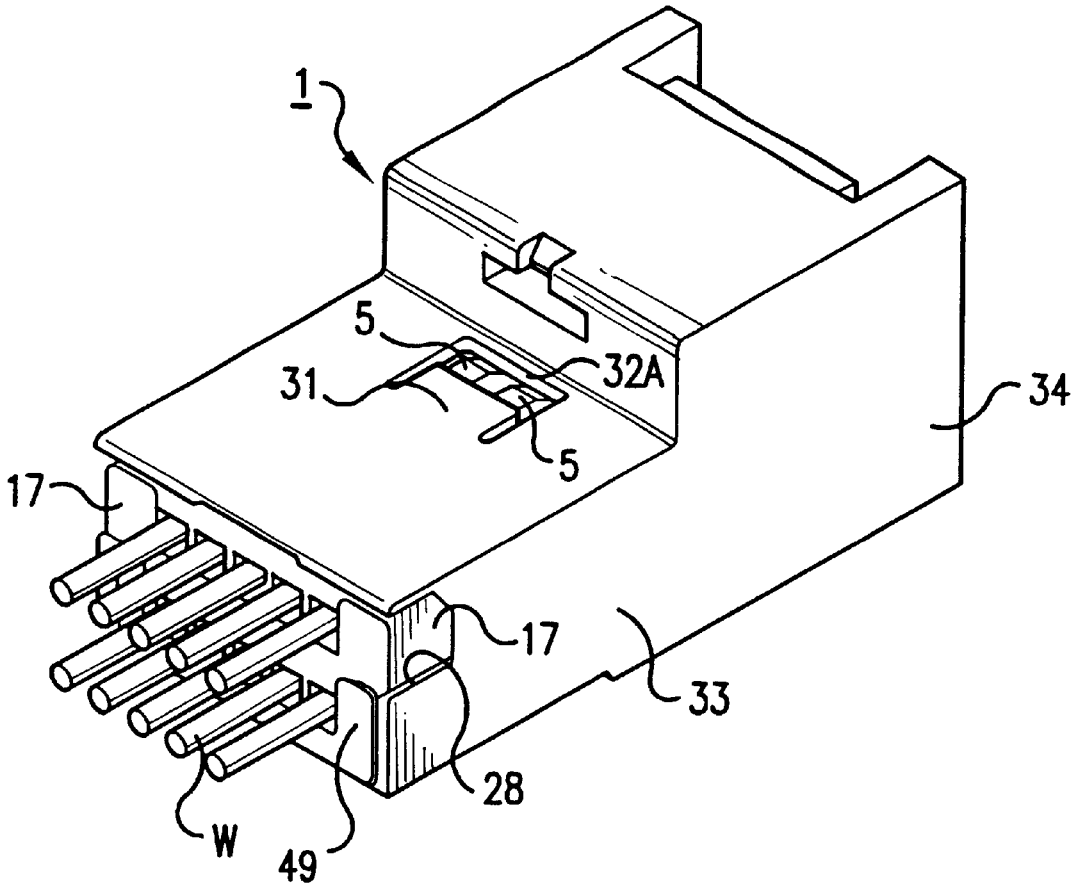
FIG. 15 is a diagonal view of the connector in which the attachment has been completed.

At this juncture, the upper face of the inner member 3 has a single unified face, whereas the lower face of the inner member 3 has a slight step formed between a protruding portion 46A of the rotatable cover 46 and the cover 44. That is, as shown in FIGS. 13 and 14, the protruding portion 46A protrudes outwards with respect to the cover 44.

Moreover, step members 57 are located on the side edge portion of all four sides of the anterior end face of the inner member 3. These step members 57 make contact with contact walls 56 provided on the outer member 4.

Outer Member

The outer member 4 is made from plastic in a unified manner and has an approximately angular tubular shape. It houses a corresponding female connector (not shown). The posterior of the outer member 4 is provided with an inner housing chamber 33 that houses the inner member 3 when the latter is in a joined state. The anterior of the outer member 4 is provided with a hood member 34 which is slightly larger than the inner housing chamber 33. The interior space of the hood member 34 is divided into two main sections, the lower section thereof forming a female connector housing space 34A that has approximately the same diameter as the inner housing chamber 33. Above the female connector housing space 34A is a locking space 34B for locking the corresponding female connector (not shown). A locking member 35 is provided on the upper side of this locking space 34B, at the centre of the upper wall of the hood member 34. The female connector (not shown) is provided with a locking arm that locks with this locking member 35, the fitting together of this locking arm and the locking member 35 maintaining the two connectors in an engaged state. A hole 19 is formed on the upper portion of the posterior face of the hood member 34 at the same time that the locking member 35 is formed. In addition, a jig guiding groove 20 is formed in a concave manner from the centre of the hole 19 to the upper face of the hood member 34. This jig guiding groove 20 is used to guide the jig 21 to separate the inner member 3 and the outer member 4 inside the connector 1 in which attachment has been completed. Furthermore, a stopping arm 36 protrudes from the lower face of the hood member 34, this stopping arm 36 being bendable in an up-down direction, the tip thereof having a hook-shaped protrusion 36A. This stopping arm 36 serves to fix the connector 1 to other members.

The inner housing chamber 33 is slightly larger than the inner member 3, and is formed in an angular tubular shape. It is thinner than the hood member 34. The inner member 3 has a pair of left and right side walls 33A, the posterior of these side walls 33A being cut-into to form a pair of left and right position-fixing grooves 28. These position-fixing grooves 28 are provided on the upper half of the posterior end of each side wall 33A. The position-fixing grooves 28 are very slightly larger than the claw receiving members 17 of the inner member 3. Furthermore, the portion of the side walls 33A which is below the position-fixing grooves 28 constitutes thin walls 33B, these thin walls 33B being thinner than the rest of the side walls 33A. A resilient member 31 is formed in the centre of the anterior portion of an upper wall 30 by making a U-shaped slit 32 into the upper wall 30, and this resilient member 31 is capable of being bent upwards. In addition, the resilient member 31 is slightly wider than the combined width of the stopping protrusions 5 which protrude from the inner member 3. The anterior side of the slit 32 forms a fitting recess 32A, the length from the anterior to the posterior of this fitting recess 32A being slightly greater than the anterior-posterior length of the stopping protrusions 5. As a result, when the inner member 3 is inserted into and attached to the inner housing chamber 33, there is a prescribed stroke clearance D in the direction of insertion and removal. Further, (see FIG. 21) when the stopping faces 5B of the stopping protrusions 5 are positioned on the ends of the resilient member 31, the anterior face 3A of the inner member 3 forms a unified face with the contact walls 56 (to be described later). An upper wall portion 30A (FIG. 9) is thinner, from its posterior end to a posterior end 31A of the resilient member 31, than other wall portions of the inner member 3, and is slightly bendable (see FIG. 11). Further, the upper wall 30 grows gradually thicker from the posterior end 31A of the resilient member 31 to the posterior end of the hood member 34, thereby increasing the strength of the upper wall 30. Moreover, thick members 55 are provided in an anterior-posterior direction on both sides of the upper wall 30, these thick members 55 being thicker than the rest of the upper wall 30. These thick members 55 form a pair on both outer sides of the resilient member 31, and the outer sides of the thick members 55 are as thin as the rest of the upper wall 30. Consequently, the left and right sides of the thick members 55 can easily be bent.

The inner housing chamber 33 has a lower wall 29. At a location corresponding to the posterior end 31A of the resilient member 31, the posterior portion of this lower wall 29 is lower in height than the anterior portion. The portion where the height changes forms a guiding face 29A. In addition, a pair of left and right ribs 54 protrude at the anterior of the lower wall 29, these ribs 54 protruding from a location corresponding to the end of the resilient member 31 to the end of the inner housing chamber 33. The posterior ends of these ribs 54 have guiding faces 54A (see FIG. 12). When the inner member 3 is to be housed within the inner housing chamber 33, these ribs 54 push and guide the inner member 3 upwards. The contact walls 56 are located at the innermost portion of the inner housing member 33, these contact walls 56 protruding inwards from the point where the upper, lower and left and right walls 29, 30 and 33A join with the innermost portion of the hood member 34. These contact walls 56 make contact with the step members 57 of the inner member 3 and stop the inner member 3 from an anterior direction. A prescribed clearance is maintained between the inner member 3 and the upper, lower and left and right walls 33A, 30, and 29 at the opening side of the inner housing chamber 33 of the outer member 4. As the inner member 3 goes deeper into the inner housing chamber 33, the clearance between it and each of the walls 33A, 30, and 29 decreases.

The jig or release tool 21 is of a screwdriver shape, the tip thereof being narrow. When separation is to be performed, the tip of the jig 21 is inserted (into, for example, the region between the stopping protrusions 5 and the resilient member 31, the jig grooves 26 for the inner member 3 when the latter is in a joined state, or the region between the claw receiving members 17 and the stopping claws 15 in the inner member 3), a levering or twisting operation or the like is performed, and the members are separated.

Next, the operation and effects of the present embodiment, configured as described above, will be explained.

The attachment operation of the inner member 3 has already been explained. This inner member 3 is positioned at the posterior of the outer member 4, and is pushed towards the inner housing chamber 33 (see FIG. 1). At this juncture, the anterior of the inner member 3, compared to the posterior of the inner member 3, becomes smaller to the extent of the thickness of the protruding portion 46A. As a result, the insertion of the inner member 3 into the inner housing chamber 33 can easily be started. When the stopping protrusions 5 of the inner member 3 make contact with the posterior end of the inner housing chamber 33, the attachment proceeds with the guiding faces 5A pushing the upper wall 30 of the inner housing chamber 33 upwards. Since the upper wall 30 of the inner housing chamber 33 is provided with the pair of thick members 55, the left and right portions of the thick members 55 bend upwards.

Next, since the lower face of the inner member 3 has a step formed between the rotatable cover 46 and the cover 44, the upper wall 30 is bent further as the rotatable cover 46 is pushed into the inner housing chamber 33.

Furthermore, as the inner member 3 is pushed further inwards, the guiding face 29A of the lower wall 29 of the inner housing chamber 33 pushes the cover 44 of the inner member 3 upwards. Thereupon, on the upper wall 30 of the inner housing chamber 33, the stopping protrusions 5 begin to bend the resilient member 31 upwards. The left and right portions of the thick members 55 bend easily and, consequently, the resilient member 31, located in the centre of the thick members 55, does not bend easily to the left or right. In this manner, the thick members 55 prevent the resilient member 31 from bending in directions other than its intended direction of bending.

Next, the edge of the cover 44 rises over the ribs 54, and the stopping protrusions 5 bend the resilient member 31 further upwards. The anterior side corners of the stopping protrusions 5 comprise curved shoulders 5C. As the inner member 3 is being inserted into the inner housing chamber 33, the stopping protrusions 5 bend the resilient member 31 upwards. As this juncture, the shoulders 5C prevent any interference with both sides of the resilient member 31 while its centre bends upwards in a curved shape. In this manner, the resilient member 31 changes shape less than in the case in which curved shoulders 5C are not provided. As a result, the resilient member 31 exerts a smaller amount of resilient force on the stopping protrusions 5 and, consequently, less inserting force is required when the inner member 3 is inserted.

Figure 21:
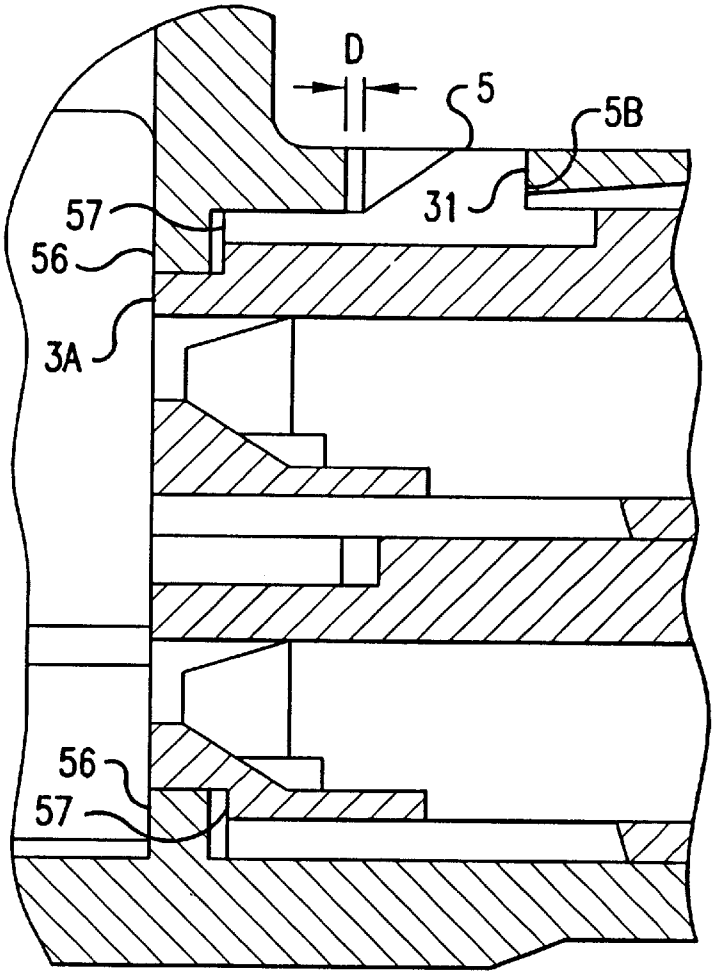
FIG. 21 is a partial side cross-sectional view of the inner member, in a joined state, in the shallowest insertion position of the inner housing chamber.
Figure 20:
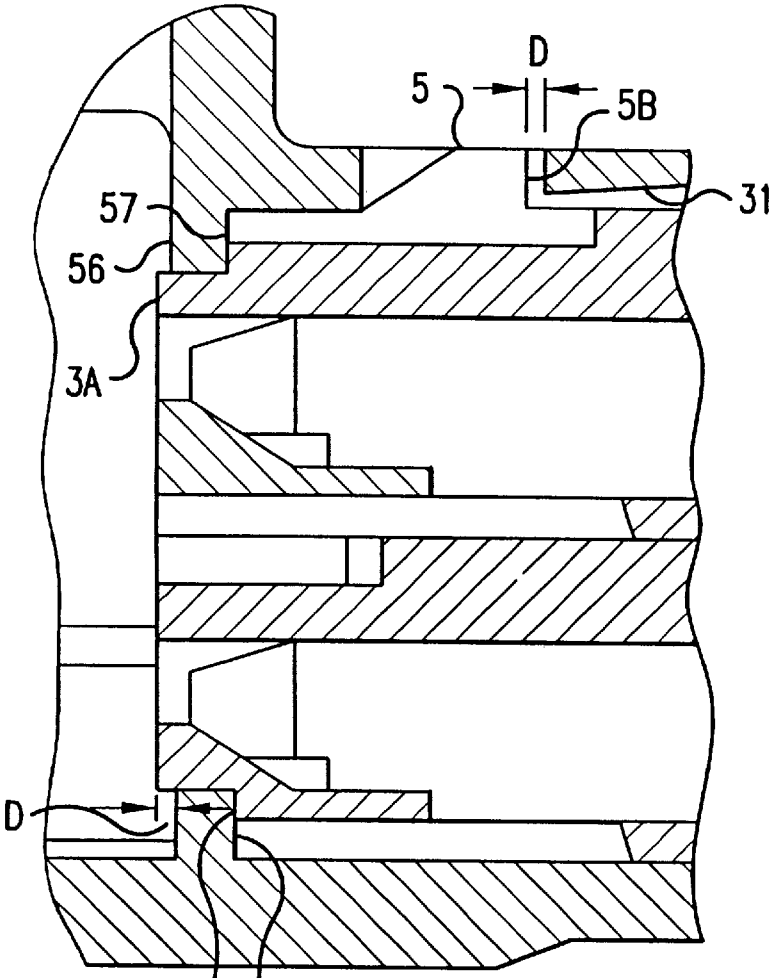
FIG. 20 is a partial side cross-sectional view of the inner member, in a joined state, in the innermost insertion position of the inner housing chamber.
Figure 22:
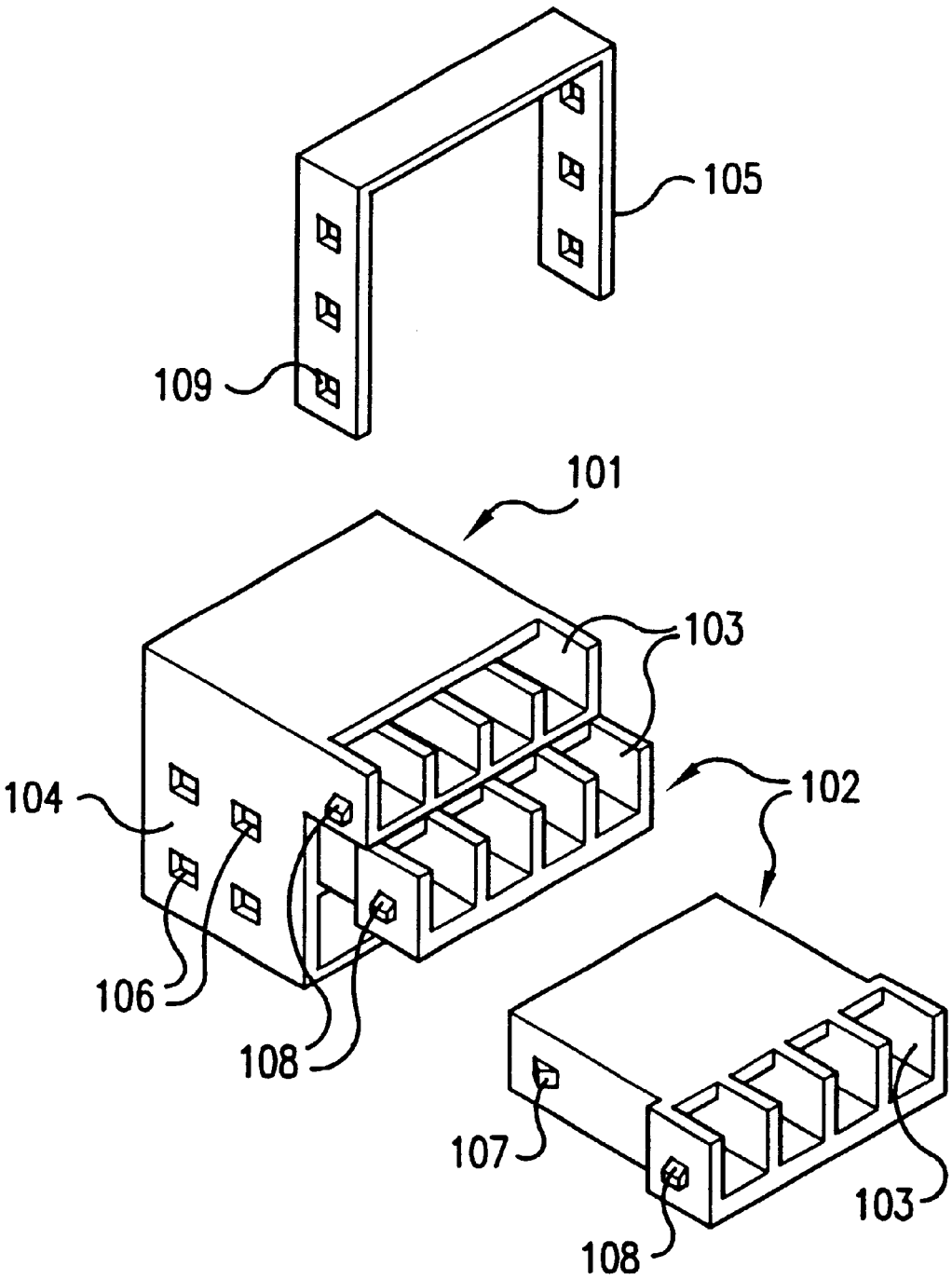
FIG. 22 PRIOR ART
FIG. 22 is a diagonal view of a conventional connector prior to attachment.

Finally, the inner member 3 is pushed into the correct housing position, the stopping protrusions 5 move past the resilient member 31, and the resilient member 31 returns to its original position. In this manner, the stopping protrusions 5 fit with the fitting groove 32A, the resilient member 31 fits with the stopping faces 5B of the stopping protrusions 5, and the inner member 3 and the outer member 4 are latched. As FIG. 20 shows, when the inner member 3 is pushed into the innermost insertion position, the anterior face 3A of the inner member 3 is inside the interior of the hood member 34. A prescribed clearance D is provided on the joining portion of the resilient member 31 and the stopping protrusions 5 and, consequently, the inner member 3 can be brought backwards in a direction of removal. When the resilient member 31 and the stopping protrusions 5 are in a joined state, the inner member 3 returns to the shallowest insertion position and, as shown in FIG. 21, the anterior face 3A of the inner member 3 forms a unified face with the contact walls 56. If the inner member 3 is in the innermost insertion position and the anterior face 3A of the inner member 3 is made to form a unified face with the contact walls 56, in the case where there is a clearance D, the inner member 3 returns in the direction of removal and a step appears between the anterior face 3A of the inner member 3 and the contact walls 56. As a result, when the corresponding connector is fitted into the hood member 34, the anterior faces of the two connectors cannot make full contact with one another. Consequently, a space is formed between the anterior faces of the two connectors, and this space causes rattling.

In the connector 1 of the present embodiment, since the anterior faces of the two connectors can be made to fit together when they face each other, this rattling can be prevented.

Furthermore, at the posterior end portion of the inner housing chamber 33, the claw receiving members 17 fit with the position-fixing grooves 28. In this manner the attachment of the connector 1 is completed.

The protruding portion 46A protrudes towards the exterior from the posterior of the inner member 3. Consequently, when the inner member 3 is housed within the inner housing chamber 33, the protruding portion 46A fills the clearance of the entrance hole of the inner housing chamber 33. As a result, rattling or vibration of the inner member 3 and the outer member 4 is prevented.

After the attachment of the connector 1 has been completed, there will be occasions where it must be disassembled for purposes such as maintenance. This operation will now be explained.

Figure 16:
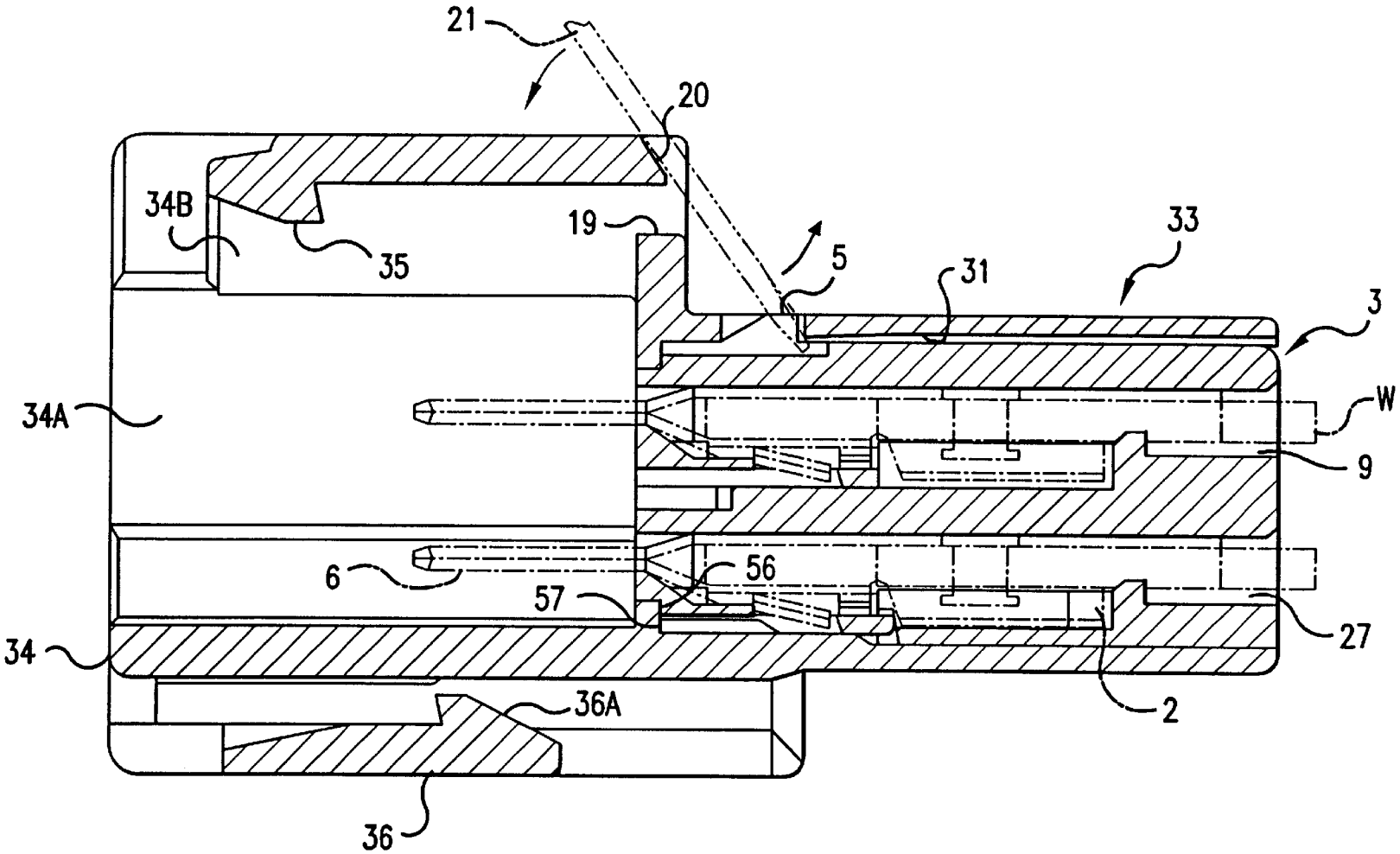
FIG. 16 is a side cross-sectional view of the connector in which a release tool has been inserted between stopping protrusions and a resilient member.
Figure 17:
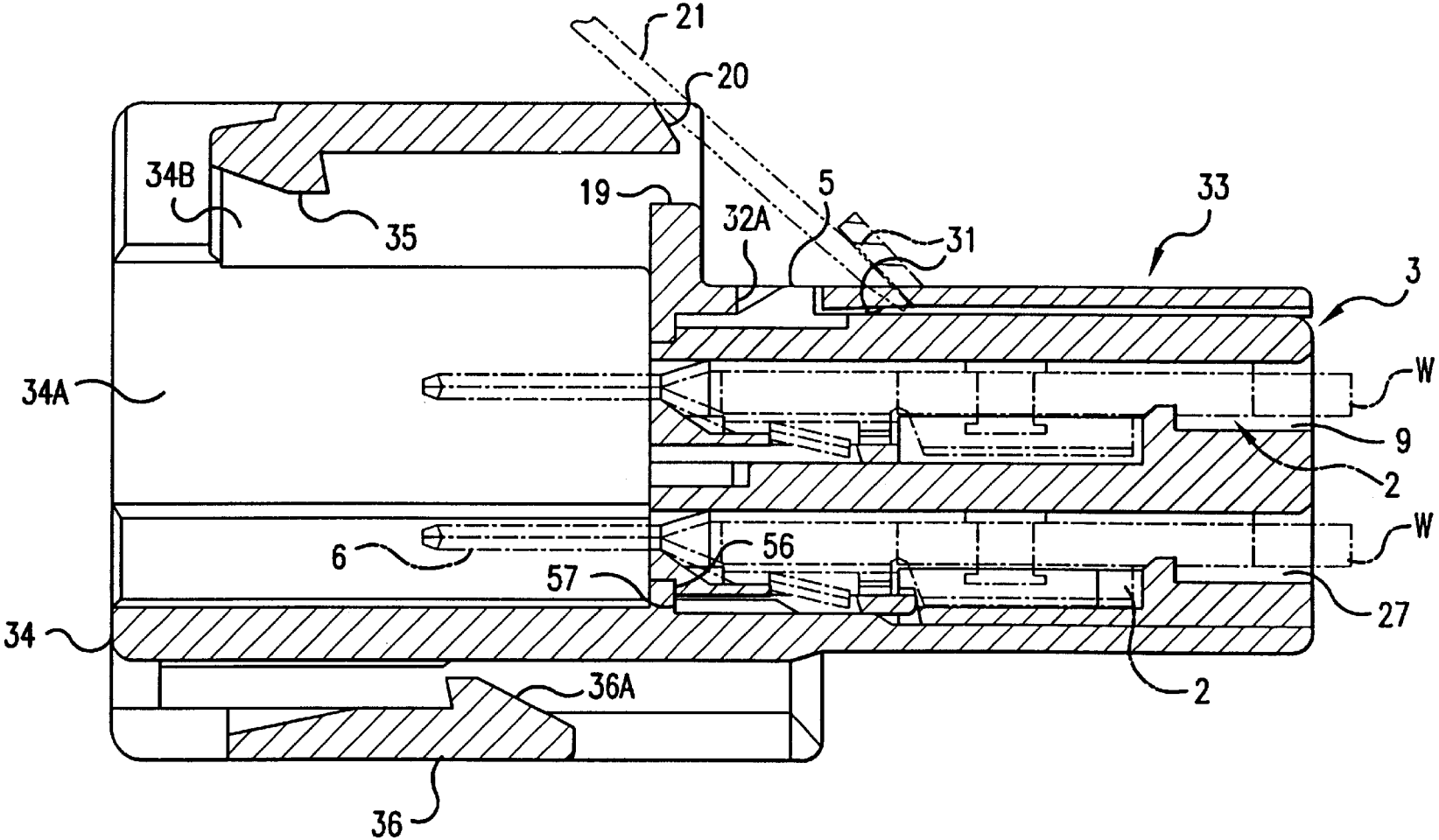
FIG. 17 is a side cross-sectional view of the connector in which the resilient member is bending due to the release tool.
Figure 18:
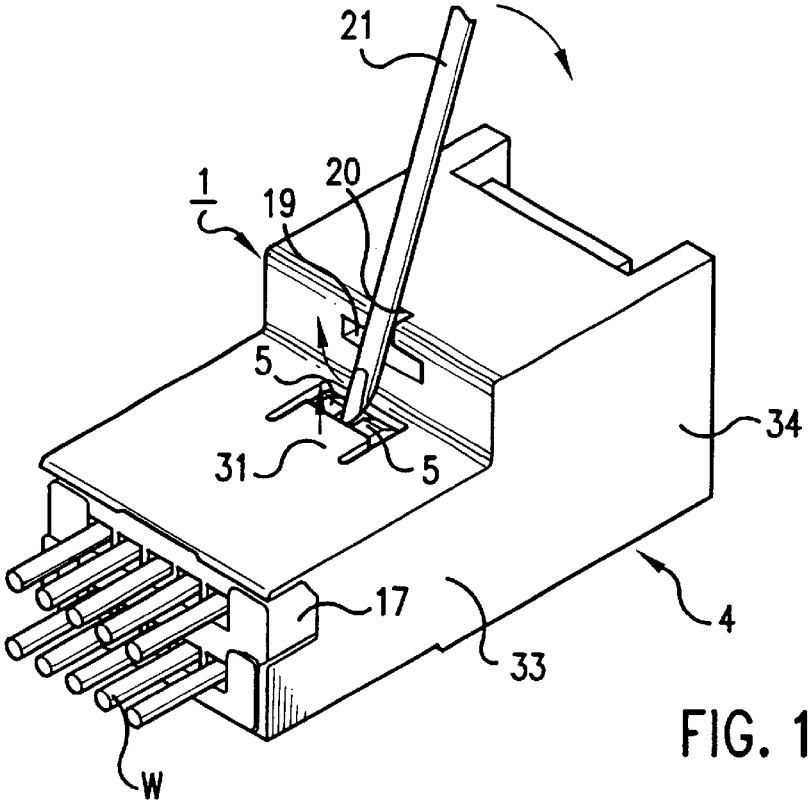
FIG. 18 is a diagonal view of the connector in which the release tool has been inserted between the stopping protrusions and the resilient member.
Figure 19:
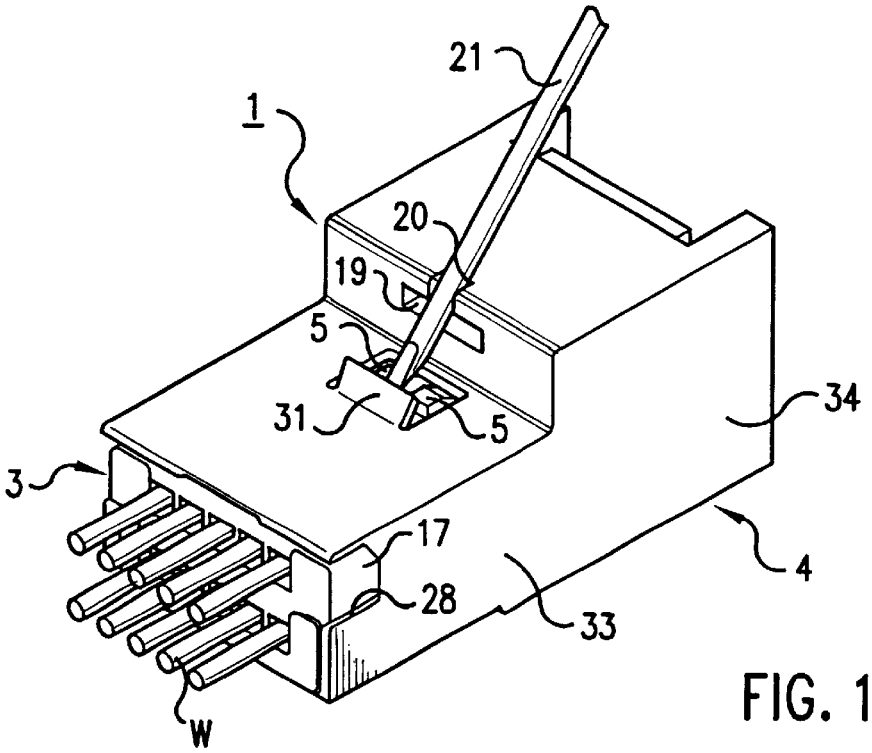
FIG. 19 is a diagonal view of the connector in which the resilient member is bending due to the release tool.

First, in order to separate the fitting together of the stopping protrusions 5 and the resilient member 31, the jig 21 is applied to the jig guiding groove 20 of the outer member 4, and the tip of the jig 21 is pushed into the fitting releasing groove 18 of the inner member 3 (see FIG. 16 or 18). Then the tip of the jig 21 is pushed upwards in the direction of the arrow in FIG. 16 or 18, and the resilient member 31 is resiliently bent, thereby releasing the stopping protrusions 5 and the resilient member 31 (see FIG. 17 or 19). In this state, the left and right claw receiving members 17 are pinched and simultaneously withdrawn from the inner housing chamber 33. Maintenance can be performed after the inner member 3 and the outer member 4 have been separated in this manner.

In this way, when the inner member 3 and the outer member 4 are to be separated, the jig guiding groove 20 is employed, and the jig 21 is pushed into the fitting releasing groove 18. The jig guiding groove 20 is provided on the hood member 34 and, consequently, the jig 21 can be inserted smoothly. Further, the fitting releasing groove 18 is provided on the central portion of the stopping protrusions 5 and, consequently, the jig 21 can be inserted easily.

According to the present embodiment, since the configuration is such that the inner member 3 is covered by the outer member 4, the joining with respect to the inner member 3 is effected with certainty.

Further, the inner member 3 is assembled before being attached to the outer member 4. As a result, the inner members 7 and 8 are prevented from rattling against one another, and they do not move in the direction of the terminal housing chambers 9 and 27.

Furthermore, a prescribed clearance is provided in the vicinity of the entrance to the inner housing chamber 33. Consequently, the inner member 3 can be inserted easily when it is to be housed within the inner housing chamber 33. Further, as the insertion proceeds, the inner member 3 is guided towards the resilient member 31 by the ribs 54. In this manner, the inserting force can be reduced once insertion has begun, and the locking together of the two members 3 and 4 can be effected with certainty.

The present invention is not limited to the embodiments described above. For example, the possibilities described below also lie within the technical range of the present invention.

(1) In the present embodiment only a male connector which houses male terminal fittings is shown. However, according to the present invention, a female connector can be used to house female terminal fittings.

(2) The terminal housing chamber may be of more than two layers.

(3) The locking protrusions may equally well be provided on the outer member, and the resilient member provided on the inner member.

What is claimed is:

1. An electrical connector comprising inner housings adapted to be layered together; said inner housings each receiving a pressure contact terminal such that a connection part of the respective terminal is exposed in situ for the pressure connection of a respective electrical wire and a connecting tab portion of the respective terminal extends outwardly away from an outer face of its respective inner housing, an outer housing receiving the inner housings therein to form an integral housing adapted to couple with a mating connector, the outer housing including a hood portion extending about the connecting tab portions and including an opening for receiving the mating connector to electrically couple to the connecting tab portions, wherein the outer housing retains the inner housings in a layered state, and a latch is provided to retain the inner housings in said outer housing.

2. A connector according to claim 1, wherein said latch comprises a protrusion on one of said inner housings, and a resilient tongue on said outer housing, said protrusion having rounded shoulders at the sides thereof and being adapted to bend said tongue during insertion of said inner housings, the protrusion also defining an abutment for engagement against a tip of said tongue on full insertion of said inner housings within said outer housing.

3. A connector according to claim 2, wherein said outer housing has a relatively thin wall portion extending in a direction of insertion of said inner housing, said thin wall portion contacting said protrusion when said inner housings are inserted in said outer housing, and a relatively thick wall portion being provided on either side of said thin wall portion.

4. A connector according to claim 2, wherein said protrusion is divided in a direction of insertion of said inner housings by a channel, said channel being adapted to guide a release tool for lifting the tip of said tongue to permit separation of said outer housing and said inner housings.

5. A connector according to claim 3, wherein said protrusion is divided in the direction of insertion of said inner housings by a channel, said channel being adapted to guide a release tool for lifting the tip of said tongue to permit separation of said outer housing and said inner housings.

6. A connector according to claim 4, wherein said outer housing is stepped, said tongue being on a lower step and a groove being provided in the adjacent edge of an upper step, said groove being adapted to guide and serve as a fulcrum of a release tool for said tongue.

7. A connector according to claim 5, wherein said outer housing is stepped, said tongue being on a lower step and a groove being provided in the adjacent edge of an upper step, said groove being adapted to guide and serve as a fulcrum of a release tool for said tongue.

8. A connector according to claim 1, wherein the outer housing defines a tubular mouth to receive said inner housings, the inner housings having a predetermined peripheral clearance in said mouth, and said outer housing further including inwardly directed ribs extending in a direction of insertion of said inner housings, said ribs reducing said clearance in said direction of insertion.

9. A connector according to claim 1, wherein said inner housings together define a protruding nose engageable in an end opening of said outer housing, and the inner side of said nose defining a step engageable with a wall of said outer housing for limiting relative insertion of said inner housings.

10. A connector according to claim 9, wherein on engagement of said step and wall, a predetermined clearance is provided between a protrusion on one of the inner housings and a tongue on said outer housing, said nose protruding through said wall by an amount equal to said predetermined clearance, such that on elimination of said clearance due to movement of said inner housings in the withdrawal direction, said nose is flush with an external side of said wall.

11. A connector according to claim 1, wherein said inner housings are provided with releasable engagement members to prevent relative separation thereof.

12. A connector according to claim 1, wherein two inner housings are provided and adapted to permit respective pressure contact terminals to face in opposite directions.

* * * * *